United States Patent [19]

Connors

[11] Patent Number: 4,553,729

[45] Date of Patent: Nov. 19, 1985

[54] MULTI-PANELLED CONCRETE FORMING STRUCTURE FOR FORMING FLAT CURVED WALLS

[75] Inventor: Frank T. Connors, Deerfield, Ill.

[73] Assignee: Symons Corporation, Des Plaines, Ill.

[21] Appl. No.: 568,937

[22] Filed: Jan. 10, 1984

Related U.S. Application Data

[63] Continuation of Ser. No. 326,824, Dec. 4, 1981, abandoned.

[51] Int. Cl.[4] ..... E04G 17/08

[52] U.S. Cl. ..... 249/40; 249/191; 249/194; 249/219 R

[58] Field of Search ..... 249/40, 42, 46, 47, 249/165, 166, 191, 192, 219 W, 41, 47, 192, 189, 219 R, 194

[56] References Cited

U.S. PATENT DOCUMENTS

| | | | |
|---|---|---|---|
| 1,236,824 | 8/1917 | Davis | 249/47 |
| 1,367,214 | 2/1921 | Tannenbaum | 249/189 X |
| 3,211,413 | 10/1965 | Law | 249/41 |
| 3,436,053 | 4/1969 | Person et al. | 249/192 R |
| 3,981,476 | 9/1976 | Alexander | 249/42 |
| 4,068,818 | 1/1978 | Gates | 249/42 |
| 4,254,932 | 3/1981 | Durbin | 249/40 |
| 4,290,985 | 9/1981 | Barale | 249/40 |

*Primary Examiner*—J. Howard Flint, Jr.
*Attorney, Agent, or Firm*—Charles F. Meroni, Jr.

[57] ABSTRACT

A modular concrete form structure including a series of at least three vertically extending rows of concrete form panels to be joined together in side-by-side relation as a gang for use in the formation of straight or curved concrete walls. The panels have confronting slotted panel margins about their perimeters. Fasteners secure the confronting panel margins in side-by-side relation. A series of spaced vertically aligned a horizontally positioned mini-walers are provided for mounted disposition in lapped engagement against the confronting slotted panel margins. The mini-walers each have a width exceeding the width of the form panel and being of sufficient additional width to extend over joints formed between the confronting slotted panel margins at opposite sides of each panel to provide a backing. Fasteners are provided for securing the spaced vertically aligned horizontally positioned mini-walers to the panels. An upright strongback structure is mounted in abutment against said spaced vertically aligned horizontally positioned mini-walers generally in right angle relation thereto. Fastener means secures the strongback structure in unitary assembly with the panels.

11 Claims, 27 Drawing Figures

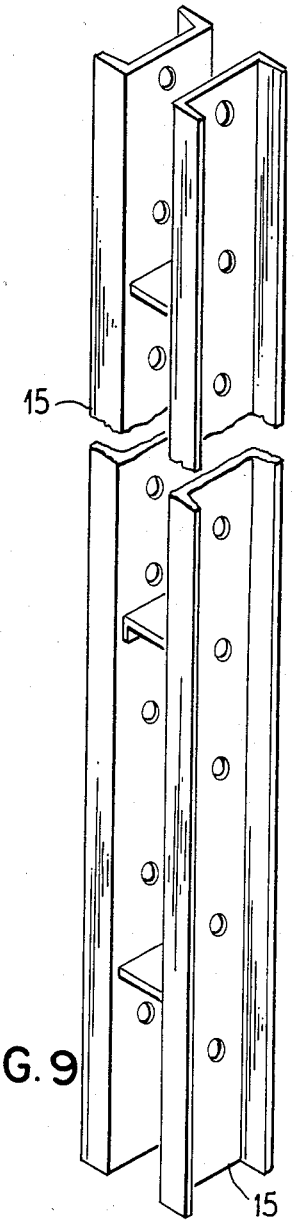
FIG. 9
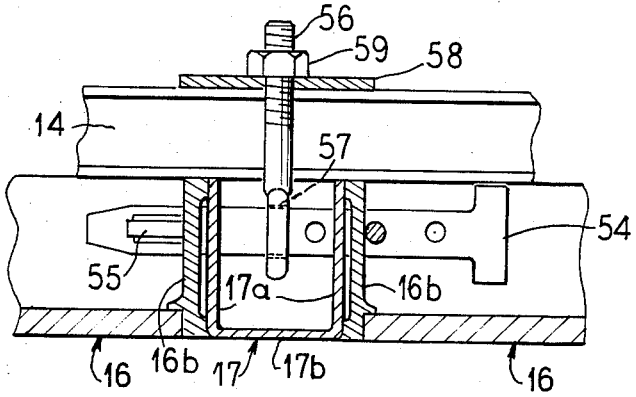
FIG. 10
FIG. 11
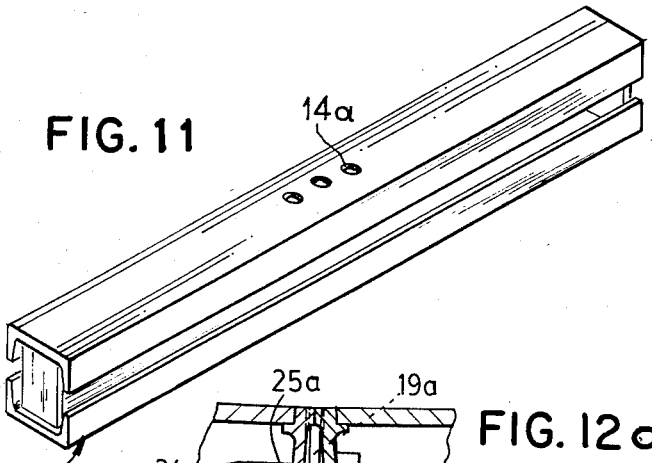
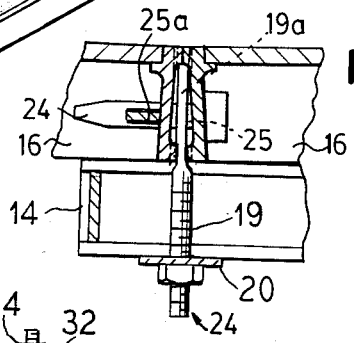
FIG. 12a
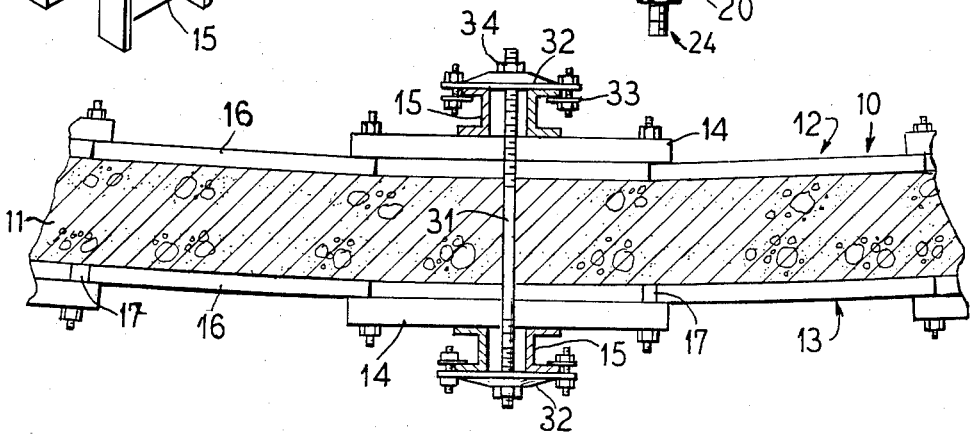
FIG. 12

MULTI-PANELLED CONCRETE FORMING STRUCTURE FOR FORMING FLAT CURVED WALLS

This application is a continuation of application Ser. No. 326,824, filed Dec. 4, 1981, now abandoned.

BACKGROUND OF THE INVENTION

1. Field of the Invention

The present invention relates to modular concrete form structure for utilizing uniquely supported concrete form panels joined together in side-by-side relation as a gang for the formation of straight or curved concrete walls. More specifically, the present invention concerns a mini-waler usable in combination with the other components of the modular concrete formed structure and which mini-waler comprises a small beam that permits the load gathering of vertically positioned concrete form panels. The mini-walers are mounted on one side of at least three vertically extending rows of concrete form panels in vertically spaced relation. The mini-walers are assembled between upright walers and the at least three vertically extending rows of concrete form panels to form a form assembly. The reusable concrete form panel assembly can be handset or ganged for crane handling and can be readily reused in building of curved walls of varying radii. Wire ties are not required, and improved tie spacing is provided in areas of 16 s.f. to 32 s.f. per tie rather than 2 s.f. to 4 s.f. to provide considerable savings in labor cost to the contractor.

According to important features of this invention, the mini-waler serves to provide a small, virtually indestructable waler used to load gather at least three vertically extending rows of concrete form panels in straight or curved walls with high capacity (taper, she-bolt, etc.) ties. The mini-walers eliminate the need for numerous wire ties or fixed radius, curved, load bearing walers. Load gathering is accomplished with straight, vertical, rentable upright walers. Bent 1.90" pipe is preferably used for alignment of curved walls. Pipe or 3" alignment channels may be used on straight walls.

In view of the foregoing, it will be now seen that it is an important object of this invention to provide a new and improved modular concrete form structure that can be more quickly assembled for the formation of curved or straight concrete walls than the concrete form structures that have been used in the past for these same purposes.

Still another important object of the invention is to provide a new improved modular concrete form structure that includes mini-walers whereby the components of the structure can be assembled more quickly and with less expense since numerous wire ties or fixed radius, curved, load bearing walers can be eliminated.

According to still other features of this invention, I have provided a modular curved concrete form structure comprised of a pair of curved sections, each section includes a series of at least three vertically extending rows of concrete form panels to be joined together in curving side-by-side relation as a gang for use in the formation of curved concrete walls. The panels have confronting slotted panel margins about their perimeters. Fasteners serve the confronting panel margins in curving side-by-side relation. A series of spaced vertically aligned and horizontally positioned mini-walers are provided for mounted disposition and lapped engagement against the confronting slotted panel margins.

The mini-walers each has a width exceeding the width of the form panel and is of sufficient additional width to extend over joints formed between the confronting slotted panel margins at opposite sides of each panel to provide a backing. Fasteners are provided for securing the spaced vertically aligned horizontally positioned mini-walers to the panels. An upright waler or strongback structure is mounted in abutment against the spaced vertically aligned horizontally positioned mini-walers generally in right angle relation thereto. Fastener means secure the strongback structure in unitary assembly with the panels.

Other objects and features of the present invention will become more fully apparent in view of the following detailed descriptions taken in conjunction with the accompanying drawings illustrating several embodiments wherein the following views are included:

FIG. 1 is an enlarged fragmentary rear elevation of a modular concrete form structure embodying important features of my invention;

FIG. 1*a* is a fragmentary top plan view of the modular concrete form structure shown in FIG. 1;

FIG. 9 is an enlarged fragmentary perspective view of an upright waler;

FIG. 10 is a vertical section through a portion of the modular concrete form structure showing the manner for securing the components thereof in assembly together;

FIG. 11 is an enlarged perspective view of a mini-waler;

FIG. 12 is an enlarged fragmentary partially sectioned view showing opposed assembled sections of modular concrete forms secured by means of hardware of the type illustrated in FIG. 6;

Figure 13:
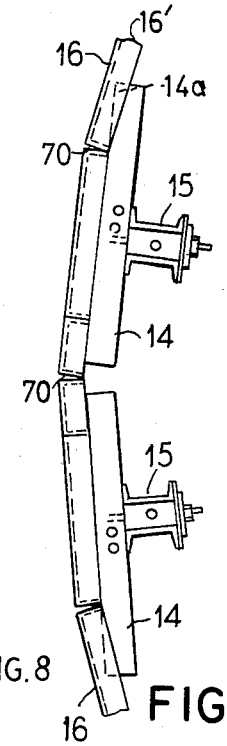
Figure 3:
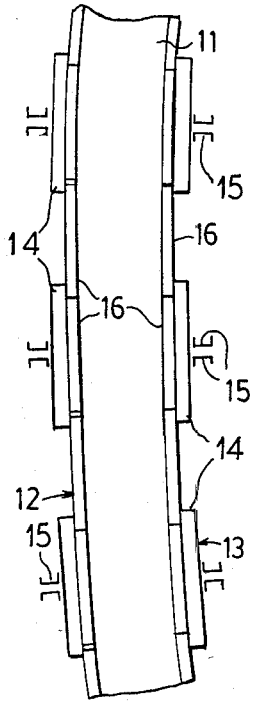
FIG. 3 is a fragmentary top plan view of a modified modular concrete form structure illustrating its usage for the formation of a curved concrete wall.

FIG. 12*a* is an enlarged fragmentary partially sectioned view illustrating the manner of attachment of the mini-waler to the panels;

FIG. 13 is an enlarged view showing edges of adjacent side-by-side panels;

FIG. 14 is a diagrammatic view of a 10' gang having an 8' waler mounted thereon;

FIGS. 15*a* and 15*b* are diagrammatic plan views of different sized gangs;

FIG. 16 is a diagrammatic view of a basic typical section illustrating a mini-waler mounted on a straight wall;

FIG. 17 is a diagrammatic top plan view of gangs for forming a curved concrete wall;

FIG. 18*a* is a fragmentary top plan view of a pair of gangs with mini-walers mounted in place thereon;

FIG. 18*b* is a fragmentary rear view of the gangs shown in FIG. 18*a;*

FIG. 19 is a top plan view of inside and outside wall gangs positioned for forming a curved wall and having alignment channels mounted thereon;

FIG. 20 is a diagrammatic view showing typical mini-waler sections having varying wall heights ranging from 12′ to 19′;

FIG. 21 is a diagrammatic view of typical mini-waler sections having wall heights in the range of 8′–11′; and FIGS. 22*a* and 22*b* show contrasting wall forms with 22*a* being entitled "normal forming" and 22*b* being entitled "mini-waler forming".

DESCRIPTION OF PREFERRED EMBODIMENTS

Figure 1:
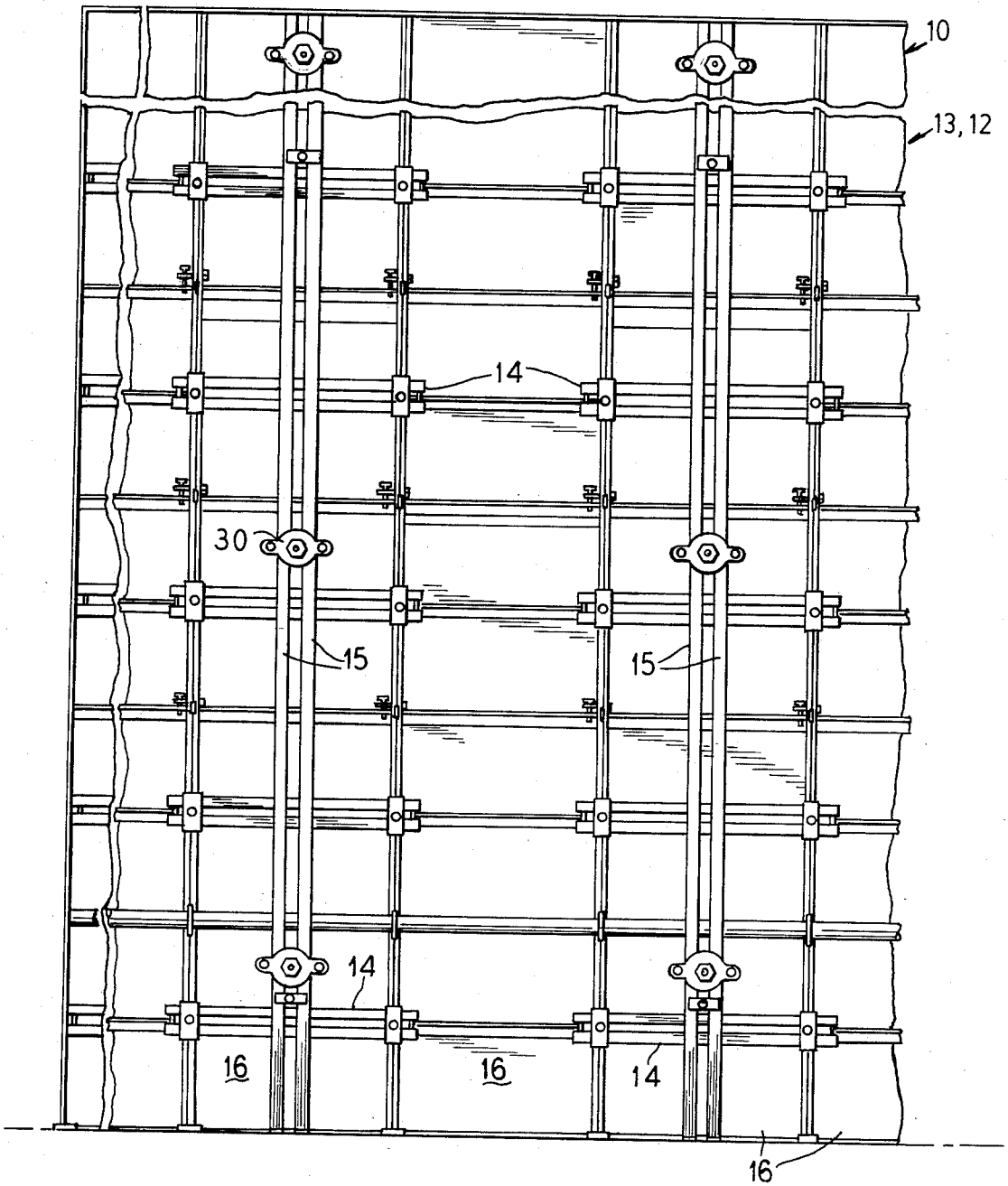
Figure 1A:
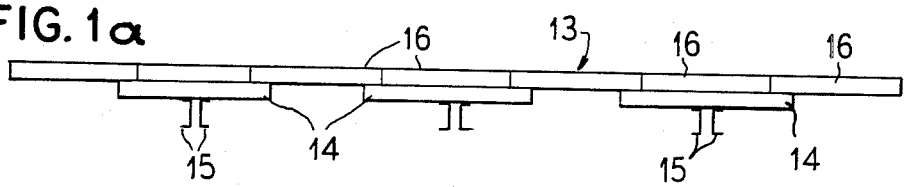
Figure 2:
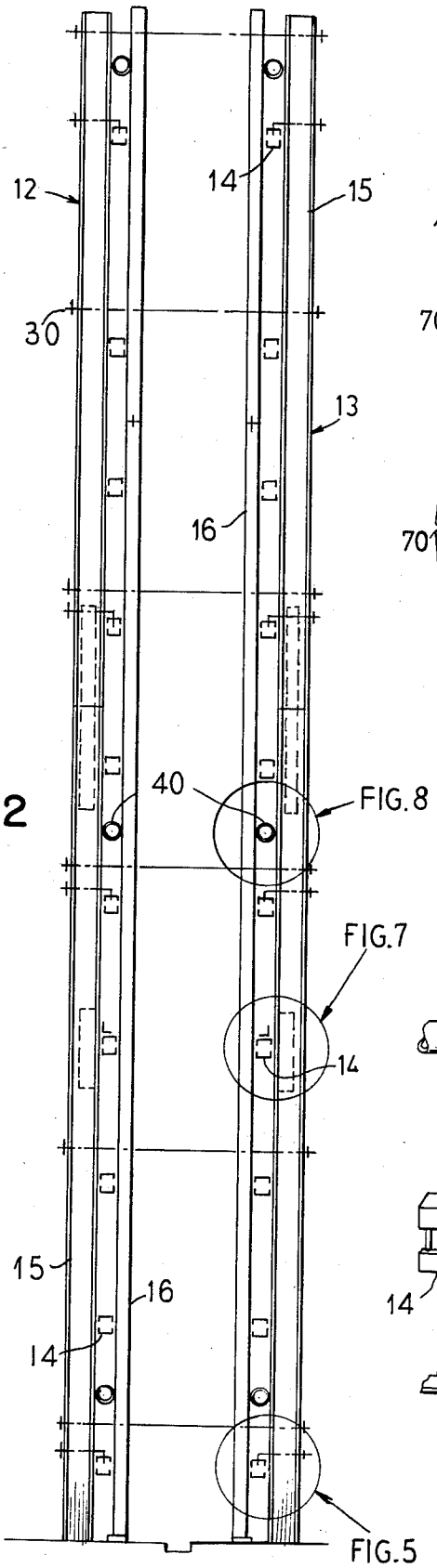
FIG. 2 is an edge elevation of the modular concrete form structure shown in FIG. 1.

The reference numeral 10, as seen in FIGS. 1, 2 and FIG. 12, among others, indicates a modular concrete form structure for forming curved or straight concrete walls 11. The structure 10 is preferably comprised of a pair of rows 12 and 13 of upright modular concrete form panels or sections 16 that can be installed in parallel relation to form a straight wall (FIG. 2) or can be installed in concentric relation to form a curved wall (FIG. 12). Each row of sections 16 are positioned in side-by-side relation, whether used to form a straight wall or a curved wall. In FIG. 12, the rows 12 and 13 of sections 16 are shown mounted in concentric curved relation. In FIG. 1A only one row of sections 16 is illustrated and it will be appreciated that if a second section were illustrated, that the rows of sections 12 and 13 would then be in parallel rather than in concentric relation. These illustrations demonstrate the versatility of utilizing panel sections 16 of the type described in combination with mini-walers 14 (FIGS. 1, 1A, 10, 11, 12) that embody important features of my invention. Cooperable with the mini-walers 14 are upright load-bearing walers or strongbacks 15 (FIGS. 1 and 9).

The sections 16 are of a modular construction. The panel sections 16 each has a face 16*a* that can be formed of any suitable material such as plywood and the like. Preferably, the plywood is of a reinforced construction and has a suitable form coating on its face for protecting the same to permit the form panels or panel sections 16 to be repeatedly used. These panel sections 16 are available in the marketplace and are well known in this art. On the back side of the plywood panel faces 16*a* are reinforced panel margins 16*b* which are of a box construction and which are horizontally reinforced at prescribed intervals by horizontally extending cross members 16*c*. According to existing practices, the panel sections 16 can be pre-engineered and factory-built to precise specifications to allow them to be used in modular form structures.

Where required, fillers 17 (FIG. 10) can be used to permit wall structures to be poured to a precise dimension and these fillers are available in the marketplace having different filler sizes to avoid the necessity of measuring, sawing, drilling and nailing of fillers into assembly with panel sections 16, thereby saving labor in the construction of modular concrete wall forms. These fillers 17 can also be reused in the same way as the mini-walers 14, panel sections 16 and the other components of my modular concrete form structure 10.

In the assembly of the form panels or panel sections 16 with the mini-walers 14 and the upright walers or strongbacks 15, various types of hardware are illustrated in the attached drawings which shall now be described in further detail.

In the build-up of a panel section 12 or 13, the panel sections 16 which are components thereof are positioned in side-by-side relation so that the mini-walers 14 and the upright walers 15 can be attached thereto. Preferably, the panel sections are laid on the ground and the mini-walers are then engaged in horizontally spaced relation on a back side of the panels 16 in abutment with the metallic panel margins 16*b*.

Figure 6:
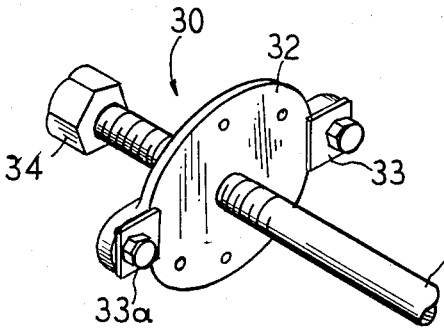
FIG. 6 is an enlarged fragmentary partially sectioned view of a tie-rod assembly for securing certain components of the modular concrete form structure in assembly together.

The mini-waler 14 is located at every other panel 16 (or filler) and attached by fasteners or fastener structure 18 to the panel sections 16 which include 8″ gang waler rods 19 and waler plates 20 (see FIGS. 1, 6 and 12). The vertical waler 15 is attached to the mini-waler 14 by fasteners or fastener structure 21 which include J-hooks 22 to 4′ to 6′ vertical spacing and connected to the mini-waler through holes 14*a*. You will note that considerable latitude exists in positioning the vertical waler. The mini-waler 14 can slide laterally over the gang waler rods 19 and, additionally, the vertical waler 15 can take three positions (FIG. 11) laterally on the mini-waler.

Figure 5:
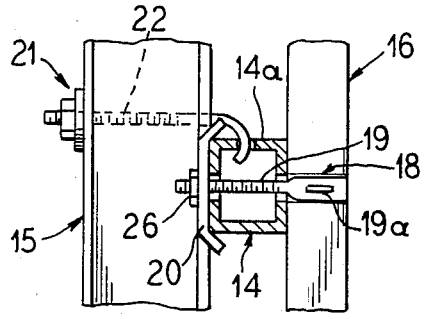
FIG. 5 is a blow-up of an encircled portion of FIG. 2 bearing the legend "FIG. 5"

In order to secure the rods 19 to the panel margins, bolts 24 (FIG. 12*a*) are extended through panel margin slots 25, 25 and through the gang waler rod slot 19*a*. A wedge bolt 25*a* locks the assemblage together. The mini-waler 14 is then engaged over the free ends of the rods 19 and the waler plates 20 are positioned and held in place by nuts 26 (FIG. 5). The plates 20 have turned ends 20*a*, 20*a* that holds the plate 20 centered against the mini-waler (FIG. 5). The panel margin 16*b* is box shaped to allow ends of the mini-waler to be lodged therein when the panel sections are mounted on a curve to form a curved wall (FIG. 13).

Figure 4:
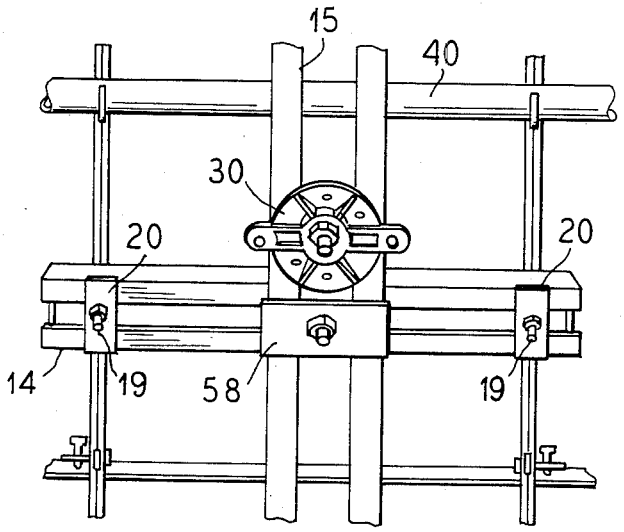
FIG. 4 is an enlarged fragmentary rear elevation of a portion of the modular concrete form structure illustrated in FIG. 1.

In FIG. 6 a strongback structure 30 is illustrated. The strongback structure serves to secure a pair of the wall forms in assembly together as illustrated in FIG. 12. The wall forms are generally indicated at 12 and 13 and are otherwise designated as rows of connected panel sections. The strongback structure 30 includes a tie rod 31, and this tie rod is of sufficient length to extend through the form structure including through the mini-walers 14—14, the upright walers or strongbacks 15, and then the ends of the tie rod extend outwardly at each end beyond the entire structure thus described. Mounted upon the ends of the tie rod are a pair of cast bearing washers 32—32. Each cast bearing washer 32 has a pair of friction clamps 33—33 which are retainingly engageable with the strongback structure 30. Friction clamp fasteners 33*a* are provided to anchor each washer at its opposite ends with associated flanges of the adjacent strongback 15 to hold the curved sections in fixed position relative to one another. Nuts 34 are provided to tightly secure the bearing washers 32—32 in clamped assembly against the strongbacks as illustrated in FIGS. 4 and 6.

In order to further tie the panel sections together, a series of curved rods 40 (FIGS. 4 and 8) are provided. To this end, J-shaped pipe aligner hooks 41 are secured with the panel margins and between the panel margins by means of wedge bolts 42 and 43. The pipe 40 can be bent to match the curvature that is desired in the concrete wall to be poured.

Figure 8:
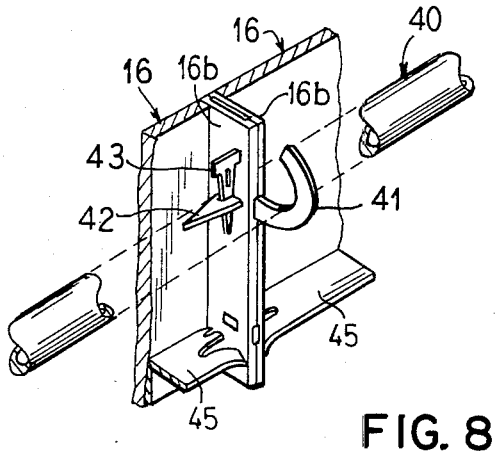
FIG. 8 is an enlarged fragmentary view of an encircled portion of FIG. 2 bearing the legend "FIG. 8"

In FIG. 8, reinforcing angles 45 are positioned beneath the curved rod 40. These angles 45 are standard and serve as means to reinforce the panels 16 and the panel margins 16*b*.

Figure 7:
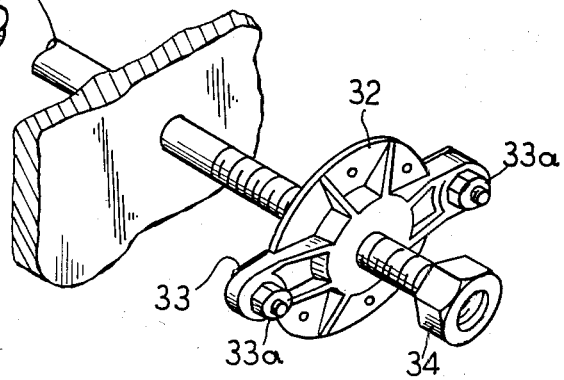
FIG. 7 is an enlarged fragmentary view of an encircled portion of FIG. 2 bearing the legend "FIG. 7"
Figure 7:
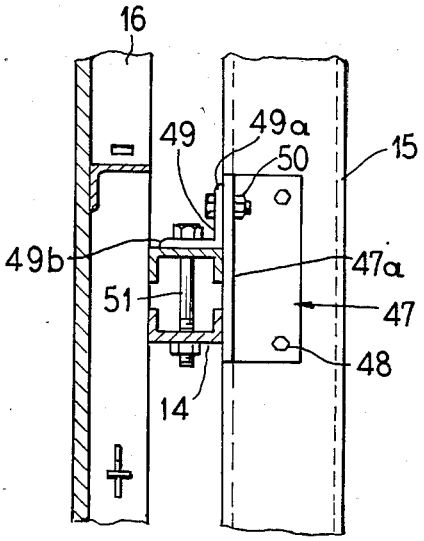

In FIG. 7 I have shown a modified means or structure for securing the mini-waler 14 in assembly with the strongback structure or vertical waler 15 in assembly together. To this end I have provided a panel-waler connector 47 which is attached by fasteners 48 to the strongback structure 15. The connector 47 has an angular flange 47*a* and mounted on this flange is an angle 49. One leg 49*a* of the angle is fastened by fasteners 50 to the connector leg 47*a*. Another leg 49*b* of the angle 49 is engaged with a side face or side surface of the mini-waler 14 and secured in assembly therewith by a bolt and nut fastener 51.

Where it is desired to provide a filler 17 (FIG. 10), it will be noted that the filler is positioned between the opposing panel margins 16*b*—16*b*. In order to secure the assemblage together, a long bolt 54 is extended through panel margins 16*b*—16*b* as well as filler margins 17*a*—17*a* and a wedge bolt 55 is employed to fasten the long bolt in secured position in assembly with the margins 16*b*—16*b* and 17*a*—17*a*. Then to secure the mini-waler 14, an I-bolt 56 is provided. The I-bolt has a slotted end 57 and the long bolt is extended therethrough as it is passed through the panel margins 16*b*—16*b* and the filler margins 17*a*—17*a*. The opposite end of the I-bolt is anchored to the mini-waler by means of a waler plate 58 and a nut 59. The size of the filler can be varied to fit the particular needs with respect to the size of the slot needed between the panel sections 16 on the outside wall form having the greater diameter. Basically, the fillers 17 are U-shaped and have a filler face 17*b* that is adapted to be matching with the inside wall surfaces of the panel sections 16—16.

Pressure is transferred through the mini-walers and as a result, the vertical walers need not be equal to the full height of the gang. As an example, a 10′ gang might use 8′ walers which is shown in the following FIG. 14.

The vertical walers are attached at alternate panels, the most simple and economic gang would be totally composed of panels, and in length increments of 4′ (10′, 14′, 18′, etc.). Obviously, this would be the way to do single gang pours. The gang length may be easily altered by replacing the panels at one or both ends with fillers as illustrated below in FIGS. 15*a* and 15*b*.

Additional "accordioning" of the gang could be achieved by replacing one or more interior panels with fillers; however, this would probably not be necessary because you could now go to a gang with only two vertical walers.

Alignment walers may be 1.90″ pipe, 3″ channel, or 2″×4″'s ripped to 3″ for straight walls. Curved walls require the use of 1.90″ pipe. Because the channels and mini-walers are both 3″ in depth, a curved 3″ channel would extend further than 3″ from the panels at the center of a panel in an outside gang. This would prevent bearing of the vertical walers against the 3″ deep mini-walers.

The possibilities in using the mini-waler on straight walls are as endless as the possibilities in using panel sold under the trademark "Steel-ply" itself. However, some basic differences should be kept in mind. The mini-waler should pick up the panel siderails at vertical spacing as shown below in FIG. 16.

However, I am not restricted to having all panel joints opposite each other. This could eliminate some problems that are usually solved by vent wire ties. Within 4′ of the top of a gang, a single 3″ alignment channel could substitute for a horizontal row of mini-walers on a straight wall to attain both alignment and pressure pick-up.

The mini-waler is particularly advantageous in the forming of curved walls due to the elimination of numerous wire ties, fixed single radius load gathering steel walers, or allegedly adjustable radius steel form systems. The curved wall is unique inasmuch as the outside is longer than the inside; therefore, the curved gang shall now be discussed in detail.

When the mini-waler 14 is assembled with the curved gang comprised of a series of panels 16, its end 14*a* can project into a space 16′ defined by a backside area 16 of the panel, as shown in FIG. 13 thereby allowing a V-shaped notch 70 to be formed in a concrete forming face area 71 of the side-by-side panel 16, 16. The notches 70 are positioned on an opposite side of the panels as compared with the location of the space 16′.

The first step in a gang layout is to determine its size. As stated previously, 10′, 14′, and 18′ are the best gang lengths. It should be kept in mind that the longer the gang and the shorter the radius, the greater the bending moment in horizontal gang alignment walers. The gang used as an example for this discussion is shown below diagram A and in FIG. 17.

WALL: Radius=72′-0″ Thickness=1′-6″

GANG: 18′-0″ long a=861.5″, b=864.0″, c=882.0″

Gang length ratio: outside/inside=c-/a=882.0/861.5=1.0237957

Steel fillers in outside gang: ((1.0237957×18′) −18′) 12=5.14″

Diagram A

Diagram A and FIG. 17 illustrate that when the tie goes through the center of an inside panel, it will usually go through the center of the opposing outside panel in a curved wall. Therefore, it may be necessary to drill the tie hole a bit off-center at the outside gang. With an intelligent use of the steel fillers, it can be seen that this offset distance can be minimized. In this example, the tie holes in the exterior gang could be centered on the panels and the offset distances are ignored. The computations for the required steel fillers and the tie hole offset distances are shown by example at Diagram A.

Whether or not the gang is done with mini-walers, bending stress is induced in the alignment walers of a curved gang in two ways: (1) angled sling handling when the gang is vertical, and (2), horizontal assembly or laydown of the gang to a horizontal position. The single 1.90″ O.D. standard pipe has an allowable bending moment of 7700 in. lbs. or 640 ft. lbs. Generally, curved gangs are assembled in the vertical position to avoid the expense and problems of assembling in the horizontal curved position. If the gang is not laid down, the only bending moment is due to vertical handling.

| | | | | | Diagram A (continued) | | | | | |
|---|---|---|---|---|---|---|---|---|---|---|
| A | B | × | C | = | D | E | = | F | G | H |
| 1 | 1.0237957 | | 15″ | | 15.3569″ | 15.0 | | +.3569″ | | .0198 |
| 2 | | | 60 | | 61.4277 | 61.5 | | | −.0722″ | .0040 |

-continued

| A | B | × | C | = | Diagram A (continued) D | E | = | F | G | H |
|---|---|---|---|---|---|---|---|---|---|---|
| 3 | | | 108 | | 110.5699 | 110.5 | | +.0699 | | .0039 |
| 4 | | | 156 | | 159.7121 | 160.0 | | | −.2879 | .0160 |
| 5 | | | 201 | | 205.7829 | 206.0 | | | −.2171 | .0121 |
| 6 | | | 216 | | 221.1398 | 221.0 | | | | |

A = Tie hole and end of gang
B = Outside/Inside gang length ratio
C = Distance from beginning of inside gang to $C_L$ of panel (inches)
D = Distance from beginning of outside gang to tie hole (inches)
E = Distance from beginning of outside gang to $C_L$ of panel (inches)
F = Offset distance of outside gang tie hole to right of panel $C_L$ (inches)
G = Offset distance of outside gang tie hole to left of panel $C_L$ (inches)
H = Tanget of tie angle (F or G ÷ 18")
If "H" exceeds 0.02, drill holes to right or left of panel $C_L$ per "F" or "G" and indicate on drawing in fraction of inch to nearest 1/16".

It will be noted that the gang ends consist of a 6F+18F (FIG. 18*a*) instead of a 24" panel. As shown in FIG. 18*a* (curvature exaggerated for clarity), the 6F+18F will be straight when joined and will give a 24" chord. More important, the 6F will "cantilever" from the 18F. This means that the gang, in effect, will become a large "panel", and, therefore, erection and stripping requires nothing more than wedge bolts at the joint of the two gangs. By cutting the pipe to length so that the ends are in the 6F width, the pipes will not interfere with erection or stripping. Some contractors prefer to let the pipes lap the two gangs. When stripping, a lapping pipe can be "unlapped" by knocking it back with a sledge hammer. This seems like unnecessary labor, but it is a matter of preference by the contractor. FIG. 18*a* points out that the mini-waler has been offset by 1½" to prevent contact with the mini-waler of the adjacent gang. The tie may remain at the center of the 18F although this is not necessary.

Diagram B

GIVEN: $r$ = radius = 50'-0" = 600"
Gang weight = 3000 lbs.
Minimum sling angle = 60°
Distance between pick-up points = 10'-0"

FIND: $M$(midorinate distance) and bending moment $$M = r - \sqrt[\frac{1}{2}]{4r2 - C2}$$

$$= 600 - \sqrt[\frac{1}{2}]{4\,(600)^2 - (120)2} = 3''$$

Bending Moment = 866 lbs. × 3" = 2598 in.-lbs.

The usual method of handling a gang is with slings at an angle to two lifting brackets. The computations for the bending moment in the top pipe are shown by example (Diagram B, above). In this case, the bending moment is well under 7700 in.-lbs. If the gang weighed up to 4000 pounds, a two point pick-up would be allowable if the contractor used a lifting beam with vertical slings to the lift brackets (capacity 2000 lbs. at 5:1 S.F.). If the gang weighed more than 4000 pounds, three or more lift brackets would be required and should be rigged by the contractor to provide equal loads at the pick-up points.

If the gang weighed 6000 lbs. and the sling angle were reduced to 45° (ignoring the rated capacity of the lift brackets) the bending moment in the pipe would exceed 7700 in.-lbs. Double pipes would be required at the top.

The bending moment in a curved gang is usually critical if the gang is laid in a horizontal position. Again, note that this applies to any curved gang, and is not confined to the mini-waler gang. To illustrate this point, let us assume that our curved gang weighs only 10 lbs./S.F. and is 18' wide. The bending moment at the center of the gang would be $\frac{1}{8}(10)\,(18)^2 = 405$ ft.-lbs. per foot of height of the gang. As you can see, the width of the gang is squared; therefore, the bending moment can be reduced considerably by reducing the gang width. If the gang were 14' wide the moment would be reduced to $\frac{1}{8}(10)\,(14)^2 = 245$ ft.-lbs. and a 10' width would be 125 ft.-lbs. At first, this does not seen like a good solution, but it actually has a number of practical advantages. A 20' high wall built in 10' form widths would give low weight, could be handled with two lift brackets and would have a low bending moment for handling and/or lay down. In effect, you would be "pinning" together 200 S.F. curved panels. This is considerably more than the basic 4'×8' "flexible" panel advertised by a competitor.

If the gang is to be laid down and it is desired to have a wide gang, the gang can be reinforced for bending quite easily with two or three double 3" rentable alignment channels as shown in FIG. 19, as follows:

An 18' wide gang is illustrated in FIG. 19. Assuming a weight of 15 lbs./S.F., we have a "lay-down" bending moment of $\frac{1}{8}(15)\,(18)^2 = 607.5$ ft.lbs. per foot of height. The double 3" channels have a resisting moment of 4032 ft. lbs. Therefore, three double 3" channels would handle a 20' high gang. You will note that the channels need not be 18' long.

Obviously, the mini-waler will be used chiefly in crane handled gang units. Normally, a tank will consist of a number of pours so that stripping presents no problem. However, keep in mind that if a small tank is to be erected for one pour, your must insert a job-built filler as a starting point to strip.

Typical sections of various wall heights follow. You will note that an 8' high wall may be done with a 4' upright waler and one tie in the concrete resulting in 32 sq. ft. of wall (64 s. ft. of forming) per tie. Two other alternates are shown for the 8' wall. Wall heights in 1' increments are shown up to 19'. From these illustrations you will see the patterns for tie spacing, mini-waler spacing, and waler lengths. You will note that the waler is shorter than the wall height. This is possible because, unlike upright walers, the structural elements 12 are vertical, and cantilever 2' at top and 1' at the bottom. As mentioned previously, 1.90" pipe must be used for alignment on curved walls. Spacing of alignment walers should be 8' to 10' O.C.

FIG. 20 shows a basic 4'-0" vertical spacing of 36 kip ties. When a 50 kip tie is available, additional information can be secured giving extended vertical spacing of ties.

FIG. 21 illustrates typical mini-waler sections in wall heights of 8′ to 11′. The mini-walers 14 are erected in different positions relative to the strongbacks 15 depending on the height of the sections 16 to be assembled therewith.

In FIGS. 22*a* and 22*b*, the illustration entitled "Normal Forming" shows the time consuming prior art technique (FIG. 22*a*) of constructing a concrete form structure where wire ties must be manually installed and then disassembled when the form structure is to be removed. The other illustration in FIG. 22*b* entitled "Mini-Waler Forming" shows how the wire ties are eliminated and how the mini-walers 14 can be quickly installed at preselected intervals and then disassembled resulting in substantial reductions in form set-up and known down time periods.

I claim:

1. In a modular curved concrete form structure, wherein the improvement comprises a pair of curved sections with one section having a greater diameter, each section including a series of at least three vertically extending rows of modular concrete form panels joined together in curving side-by-side relation as a gang providing a generally curved surface concrete forming area, the panels each having confronting slotted panel margins about its perimeter, fasteners securing the confronting panel margins in curving side-by-side relation, a series of spaced vertically aligned and horizontally positioned modular flat sided walers mounted in lapped engagement against said confronting slotted panel margins, said walers each having a width less than the width of a pair of the panels but exceeding the width of one of said form panels only being of sufficient additional width to extend over joints formed between the confronting slotted panel margins at opposite sides of each panel to provide a backing, fasteners securing the spaced vertically aligned horizontally positioned walers to the panels, upright strongback structure mounted in abutment against said spaced vertically aligned horizontally positioned walers generally in right angle relation thereto, and fastener means securing said strongback structure in unitary assembly with said panels.

2. The structure of claim 1 further defined by the modular panels each having a slot forming face on one side and said slotted panel margin on an opposite side, the slotted panel margin being box-shaped and defining an opensided cavity, ends of said waler being extendable into said open sided cavities thus enabling said panels and their flat forming faces to be oriented to form said curved surface concrete forming area.

3. The structure of claim 1 further defined by said panels having engaging opposed edges on opposite sides thereof, the opposed edges defining vertically extending V-shaped joints with a closed end of the V being located in said curved surface concrete forming area.

4. The structure of claim 1 further defined by said waler comprised of a pair of spaced U-shaped waler channels and longitudinally spaced waler connector plates rigidly connected in assembly with the U-shaped waler channels and with the channels providing spaced parallel flat surfaces, with one flat surface being engageable with said curved gang of side-by-side panels and with another flat surface being engageable by said strongback structure.

5. The structure of claim 1 further characterized by the forming surface area of the outside of row of curved wall panels being longer than the inside surface area.

6. The structure of claim 1 further defined by U-shaped fillers being positioned between the panels of the curved section having a greater diameter, filler fastener means for securing the fillers in fixed detachable knockdown assembly with adjoining ones of said panel margins, ends of the waler fasteners extending into the U defined by the U-shaped fillers and with said filler fastener means coacting to secure said waler fastener in assembly with the associated curved section.

7. In a modular concrete form structure wherein the improvement comprises a series of at least three vertically extending rows of reusable concrete form panels to be joined together in side-by-side relation as a gang in the formation of a curved concrete wall, the panels having confronting slotted panel margins about their perimeter, fasteners securing the confronting panel margins in each series in side-by-side relation, a series of spaced vertically aligned and horizontally positioned walers for said panels and being mounted in lapped engagement against said confronting slotted panel margins, said walers each having a width less than the width of a pair of the panels but exceeding the width of one of said form panels and only being of sufficient additional width to extend over joints formed between the confronting slotted panel margins at opposite sides of each panel to provide a backing, fasteners for securing the spaced vertically aligned horizontally positioned walers to the panels in each series, upright strongback structure for each series mounted in abutment against said spaced vertically aligned horizontally positioned walers generally in right angle relation thereto and tie rod fastener means securing said strongback structures with said panels thereby connecting said transversely spaced first and second rows of panels in unitary assembly in readiness for a concrete pout to form a concrete wall.

8. The structure of claim 7 further defined by the modular panels each having a slot forming face on one side and said slotted panel margin on an opposite side, the slotted panel margin being box-shaped and defining an open sided cavity, ends of said waler being extendable into said open sided cavities thus enabling said panels and their flat forming faces to be oriented to form said curved surface concrete forming area.

9. The structure of claim 7 further defined by said panels having engaging opposed edges on opposite sides thereof, the opposed edges defining vertically extending V-shaped joints with a closed end of the V being located in said curved surface concrete forming area.

10. The structure of claim 7 further defined by said waler comprised of a pair of spaced U-shaped waler channels and longitudinally spaced waler connector plates rigidly connected in assembly with the U-shaped waler channels and with the channels providing spaced parallel flat surfaces, with one flat surface being engageable with said curved gang of side-by-side panels and with another flat surface being engageable by said strongback structure.

11. The structure of claim 7 further defined by U-shaped fillers being positioned between the panels of the curved section having a greater diameter, filler fastener means for securing the fillers in fixed detachable knockdown assembly with adjoining ones of said panel margins, ends of the waler fasteners extending into the U defined by the U-shaped fillers and with said filler fastener means coacting to secure said waler fastener in assembly with the associated curved section.

* * * * *